US007068488B1

(12) United States Patent
Van Leuven

(10) Patent No.: US 7,068,488 B1
(45) Date of Patent: Jun. 27, 2006

(54) STATIC DISCHARGING SYSTEM

(76) Inventor: Trent D. Van Leuven, 880 W. 400 South, Vernal, UT (US) 84078

( * ) Notice: Subject to any disclaimer, the term of this patent is extended or adjusted under 35 U.S.C. 154(b) by 228 days.

(21) Appl. No.: 10/739,120

(22) Filed: Dec. 19, 2003

(51) Int. Cl.
*H05F 3/00* (2006.01)

(52) U.S. Cl. ..... 361/220; 361/212; 361/217

(58) Field of Classification Search ..... 361/212, 361/214–220, 230, 213; 141/1
See application file for complete search history.

(56) References Cited

U.S. PATENT DOCUMENTS 3,040,211 A 6/1962 Caldwell
4,484,250 A 11/1984 Rzepecki et al.
4,800,374 A 1/1989 Jacobson
5,331,502 A * 7/1994 Bakhoum ..... 361/212
5,666,106 A 9/1997 Nasman
5,835,332 A 11/1998 White et al.
6,127,934 A 10/2000 Powell, Jr. et al.
6,426,859 B1 7/2002 Cohen
6,516,573 B1 * 2/2003 Farrell et al. ..... 52/98

* cited by examiner

*Primary Examiner*—Adolf Deneke Berhane
*Assistant Examiner*—Robert T. Dang

(57) ABSTRACT

A static discharging system includes a post having a lower end and an upper end. The lower end is selectively mounted in a ground surface adjacent to a gas pumping station such that the post extends upwardly from the ground surface. An electrically conductive plate is attached to the upper end of the post. An electrical conduit has first end electrically coupled to the plate and a second end extending into the ground surface.

6 Claims, 4 Drawing Sheets

STATIC DISCHARGING SYSTEM

BACKGROUND OF THE INVENTION

1. Field of the Invention

The present invention relates to static discharging devices and more particularly pertains to a new static discharging device for preventing static discharge while pumping gasoline.

2. Description of the Prior Art

The use of static discharging devices is known in the prior art. While these devices fulfill their respective, particular objectives and requirements, the need remains for a device that is adapted for removing static electricity before a person pumps gasoline. A static discharge during the pumping of gasoline can lead to the ignition of gasoline fumes and a subsequent explosion.

SUMMARY OF THE INVENTION

The present invention meets the needs presented above by generally comprising a post having a lower end and an upper end. The lower end is selectively mounted in a ground surface adjacent to a gas pumping station such that the post extends upwardly from the ground surface. A plate is attached to the upper end of the post. The plate comprises an electrically conductive material. An electrical conduit has first end electrically coupled to the plate and a second end extending into the ground surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
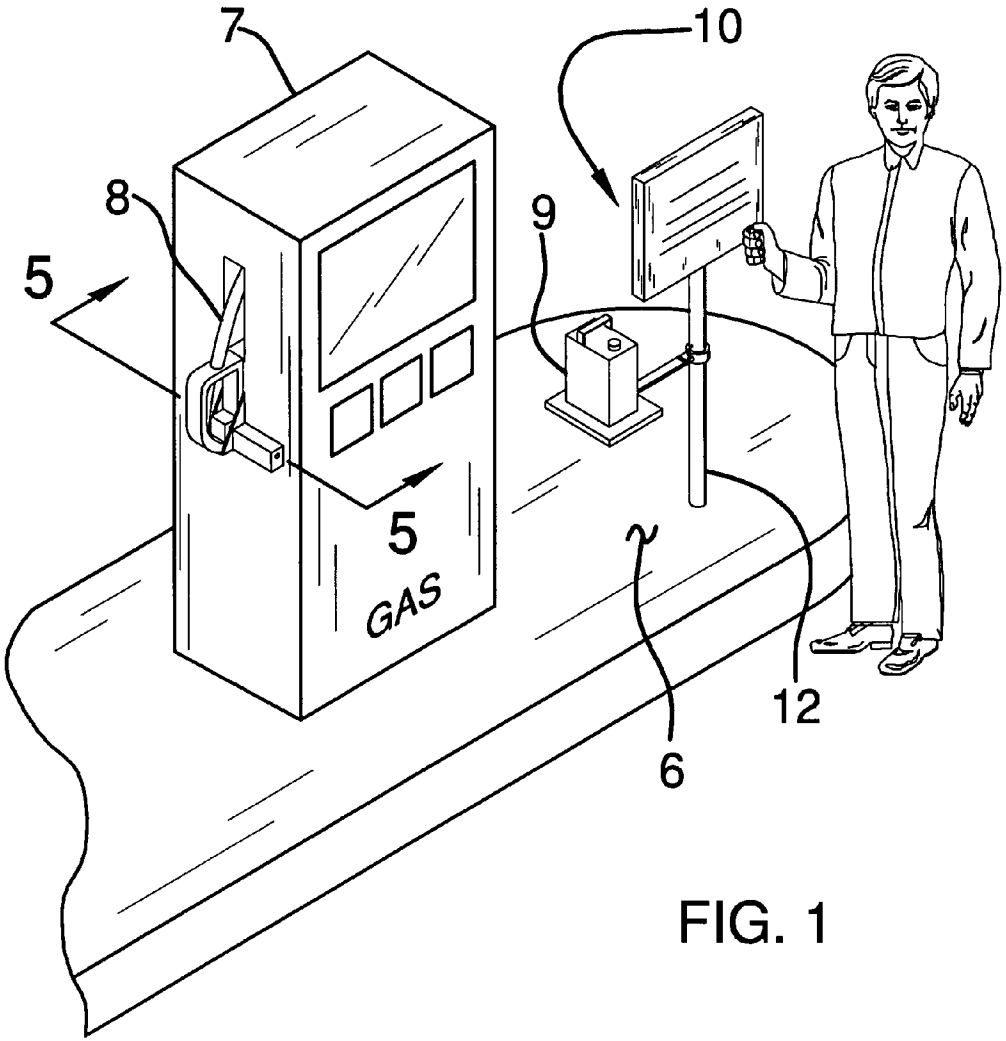
FIG. 1 is a schematic perspective environmental view of a static discharging system according to the present invention.
Figure 2:
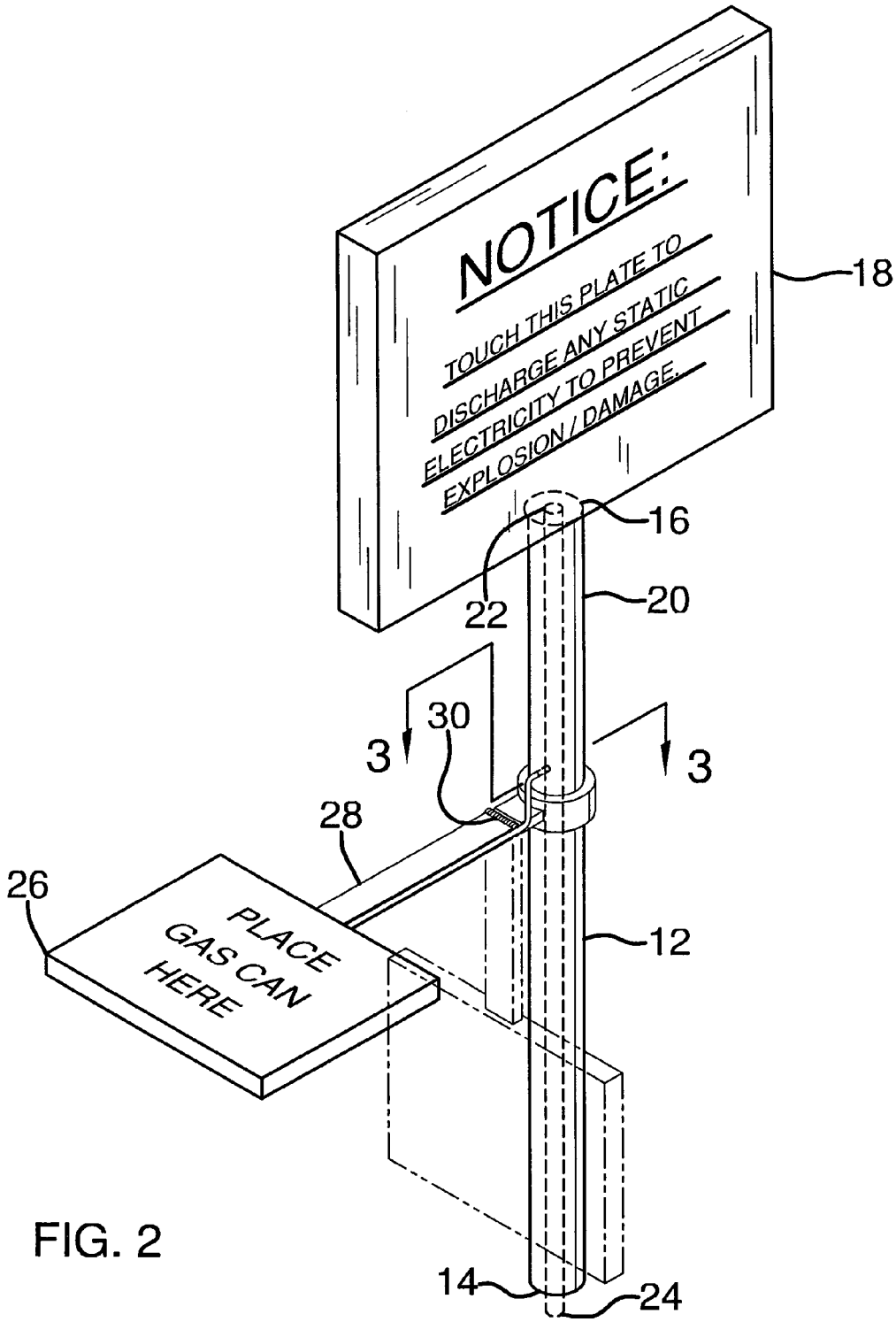
FIG. 2 is a schematic perspective view of the present invention.
Figure 3:
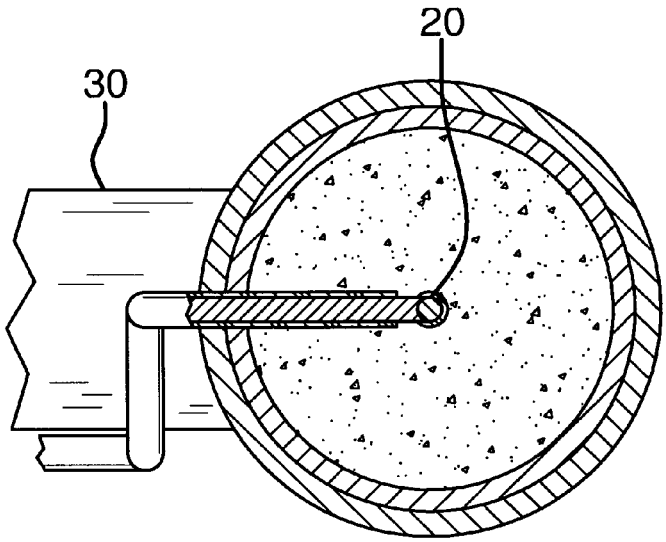
FIG. 3 is a schematic cross-sectional view taken along line 3—3 of FIG. 2 of the present invention.
Figure 4:
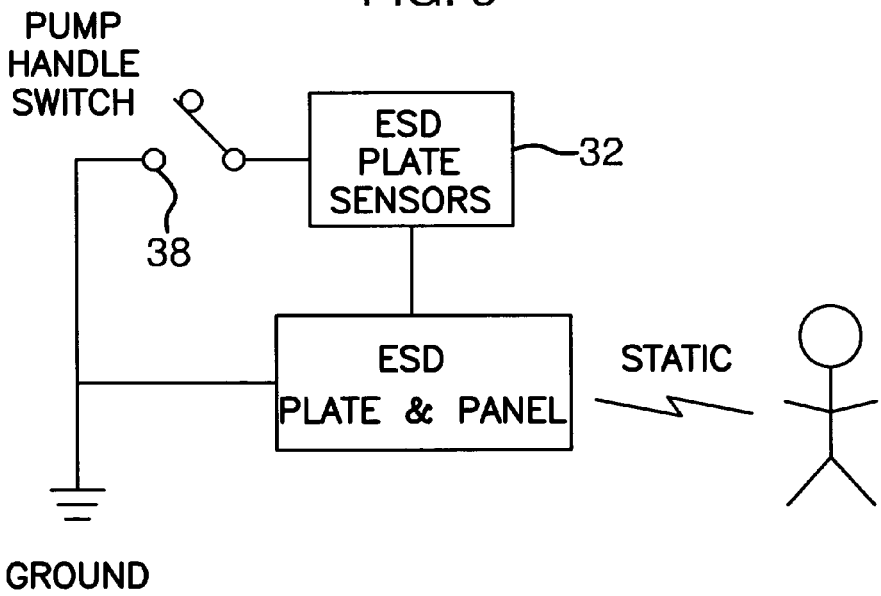
FIG. 4 is a electronic schematic view of the present invention.

With reference now to the drawings, and in particular to FIGS. 1 through 5 thereof, a new static discharging device embodying the principles and concepts of the present invention and generally designated by the reference numeral 10 will be described.

As best illustrated in FIGS. 1 through 5, the static discharging system 10 generally comprises a post 12 that has a lower end 14 and an upper end 16. The lower end 14 is selectively mounted in a ground surface 6 adjacent to a pumping station 7 such that the post 12 extends upwardly from the ground surface 6. A plate 18 is attached to the upper end 16 of the post 12. The plate 18 comprises an electrically conductive material such as copper. An electrical conduit 20 has first end 22 electrically coupled to the plate 18 and a second end 24 extending into the ground surface 6. The electrical conduit 20 preferably comprises a copper material.

Preferably, a panel 26 is mounted to and extends away from the post 12. The panel 26 is horizontally orientated and comprises an electrically conductive material. The panel 26 is electrically coupled to the electrical conduit 20. The panel 26 may be attached to the post 12 with an arm 28 which has a break 30 therein so that the panel 26 may be selectively positioned in a horizontal position or a stored position extending downwards toward the ground surface 6.

A touch sensor 32 is electrically coupled to the plate 18 and to the panel 26. The touch sensor 32 may include any conventional touch sensor assembly and will preferably include a sensor which emits a very low level electric current which is interrupted when a grounded object contacts the plate 18 or panel 26. When a person carrying a static charge contacts the plate 18 or panel 32, the static charge leaves the person while at the same time the touch sensor 32 detects that an object has contacted such.

Figure 5:
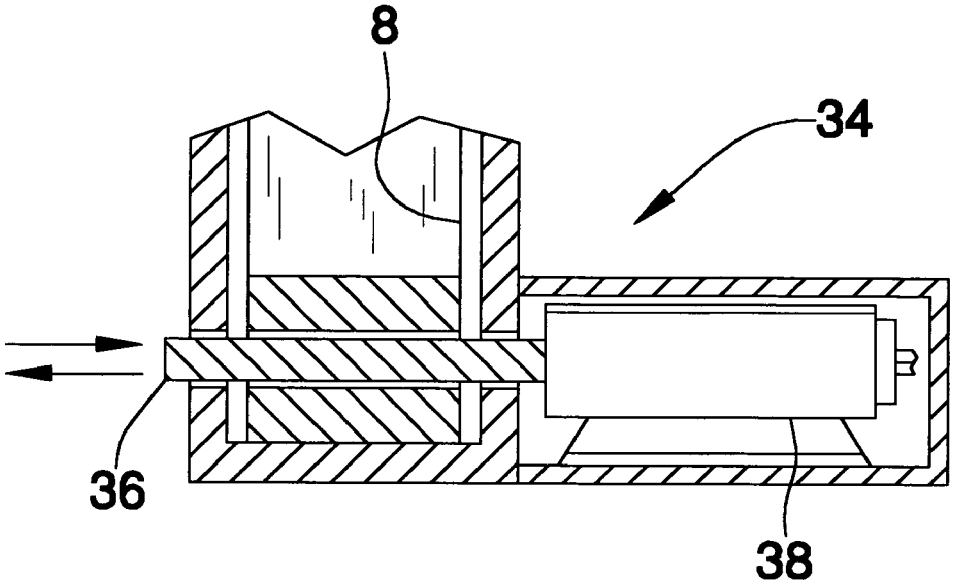
FIG. 5 is a schematic cross-sectional view taken along line 5—5 of FIG. 1 of the present invention.

A locking assembly 34 is mounted on the pumping station 7 and is electrically coupled to the touch sensor 32. The locking assembly 34 is adapted for selectively locking or unlocking a pump actuator 8 of the pumping station 7. The locking assembly 34 unlocks the pump actuator 8 when the touch sensor 32 detects an object touching the plate 18 or panel 26. The locking assembly 34 includes a locking post 36 for selectively engaging the pump actuator 8 of the pumping station. A solenoid 38 of the locking assembly 34 is mechanically coupled to the locking post 36 for selectively positioning the locking post 26 in a locked position engaging the pump actuator 8 or in an open position. FIG. 5 depicts the locking post 26 in the locked position. The touch sensor 32 is electrically coupled to the solenoid 38. The locking post 36 is moved to the open position when the touch sensor 32 detects an object touching the plate 18 or the panel 26.

In use, a person wishing to pump gasoline will first touch either the panel 26 or the plate 18 to ensure that they are not carrying an electric charge. Any static charges will be carried down the electrical conduit 20 and into the ground surface 6. If the locking assembly 34 is coupled to the touch sensor 32, then the locking assembly 34 will only release the pump actuator 8 once the panel or plate have been touched. The panel 26 is orientated for the positioning of gas cans 9 to prevent and static discharges between the pump actuator 8 and gas can 9.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A static discharge system for discharging an electric charge before pouring gas from a gas pumping station, said system including:

a post having a lower end and an upper end, said lower end being selectively mounted in a ground surface adjacent to the gas pumping station such that said post extends upwardly from said ground surface;

a plate being attached to said upper end of said post, said plate comprising an electrically conductive material;

an electrical conduit having first end electrically coupled to said plate and a second end extending into the ground surface; and a panel being mounted to and extending away from said post, said panel being horizontally orientated, said panel comprising an electrically conductive material, said panel being electrically coupled to said electrical conduit.

2. The system according to claim 1, further including a touch sensor being electrically coupled to said plate, a locking assembly being mounted on the pumping station and electrically coupled to said touch sensor, said locking assembly being adapted for selectively locking or unlocking a pump actuator of the pumping station, wherein said locking assembly unlocks the pump actuator when said touch sensor detects an object touching said plate.

3. The system according to claim 2, wherein said locking assembly includes a locking post for selectively engaging the pump actuator, a solenoid of said locking assembly being mechanically coupled to said locking post for selectively positioning said locking post in a locked position or an open position, said touch sensor being electrically coupled to said locking assembly, wherein said locking post is moved to said open position when said touch sensor detects an object touching said plate.

4. A static discharge system for discharging an electric charge before pouring gas from a gas pumping station, said system including:

a post having a lower end and an upper end, said lower end being selectively mounted in a ground surface such that said post extends upwardly from said ground surface;

a plate being attached to said upper end of said post, said plate comprising an electrically conductive material;

an electrical conduit having first end electrically coupled to said plate and a second end extending into the ground surface, said electrical conduit comprising a copper material;

a panel being mounted to and extending away from said post, said panel being horizontally orientated, said panel comprising an electrically conductive material, said panel being electrically coupled to said electrical conduit;

a touch sensor being electrically coupled to said plate and to said panel; and a locking assembly being mounted on the pumping station, said locking assembly including a locking post for selectively engaging a pump actuator of the pumping station, a solenoid of said locking assembly being mechanically coupled to said locking post for selectively positioning said locking post in a locked position or an open position, said touch sensor being electrically coupled to said locking assembly, wherein said locking post is moved to said open position when said touch sensor detects an object touching said plate or said panel.

5. A static discharge system discharging an electric charge before pouring gas from a gas pumping station, said system including:

a post having a lower end and an upper end, said lower end being selectively mounted in a ground surface adjacent to the gas pumping station such that said post extends upwardly from said ground surface;

a plate being attached to said upper, end of said post, said plate comprising an electrically conductive material; and an electrical conduit having first end electrically coupled to said plate and a second end extending into the ground surface;

a touch sensor being electrically coupled to said plate, a locking assembly being mounted on the pumping station and electrically coupled to said touch sensor, said locking assembly being adapted for selectively locking or unlocking a pump actuator of the pumping station, wherein said locking assembly unlocks the pump actuator when said touch sensor detects an object touching said plate.

6. The system according to claim 2, wherein said locking assembly includes a locking post for selectively engaging the pump actuator, a solenoid of said locking assembly being mechanically coupled to said locking post for selectively positioning said locking post in a locked position or an open position, said touch sensor being electrically coupled to said locking assembly, wherein said locking post is moved to said open position when said touch sensor detects an object touching said plate.

* * * * *